United States Patent [19]

Zitz et al.

[11] 4,076,317

[45] Feb. 28, 1978

[54] DEVICE FOR GUYING A MOVABLE CUTTING MACHINE

[75] Inventors: Alfred Zitz; Herwig Wrulich, both of Zeltweg, Austria

[73] Assignee: Vereinigte Osterreichische Eisen- und Stahlwerke-Alpine Montan Aktiengesellschaft, Vienna, Austria

[21] Appl. No.: 719,655

[22] Filed: Sep. 1, 1976

[30] Foreign Application Priority Data

Sep. 2, 1975 Austria ..... 6771/75

[51] Int. Cl.[2] ..... E21C 29/08; E21C 29/10

[52] U.S. Cl. ..... 299/75; 299/18; 299/29

[58] Field of Search ..... 299/18, 19, 29, 46–50, 299/64–67, 75, 26; 173/32, 33

[56] References Cited

U.S. PATENT DOCUMENTS

| | | | |
|---|---|---|---|
| 1,699,936 | 1/1929 | Watchorn | 173/32 X |
| 2,430,364 | 11/1947 | Peale et al. | 299/18 X |

FOREIGN PATENT DOCUMENTS

| | | | |
|---|---|---|---|
| 576,849 | 5/1933 | Germany | 299/29 |
| 447,510 | 12/1974 | U.S.S.R. | 299/29 |

*Primary Examiner*—Ernest R. Purser

*Attorney, Agent, or Firm*—Cushman, Darby & Cushman

[57] ABSTRACT

Apparatus for guying a movable cutting machine equipped with a caterpillar drive and for moving the machine on ascending galleries has at both sides of the cutting machine tension members formed of chains or ropes and led over winches. The tension members are adapted to be fixed on both sides of the cutting machine, with the forward ends and the rearward ends of the tension members being adapted to be fixed at stationary locations of the gallery, preferably by means of rock anchors.

8 Claims, 4 Drawing Figures

DEVICE FOR GUYING A MOVABLE CUTTING MACHINE

Figure 1:
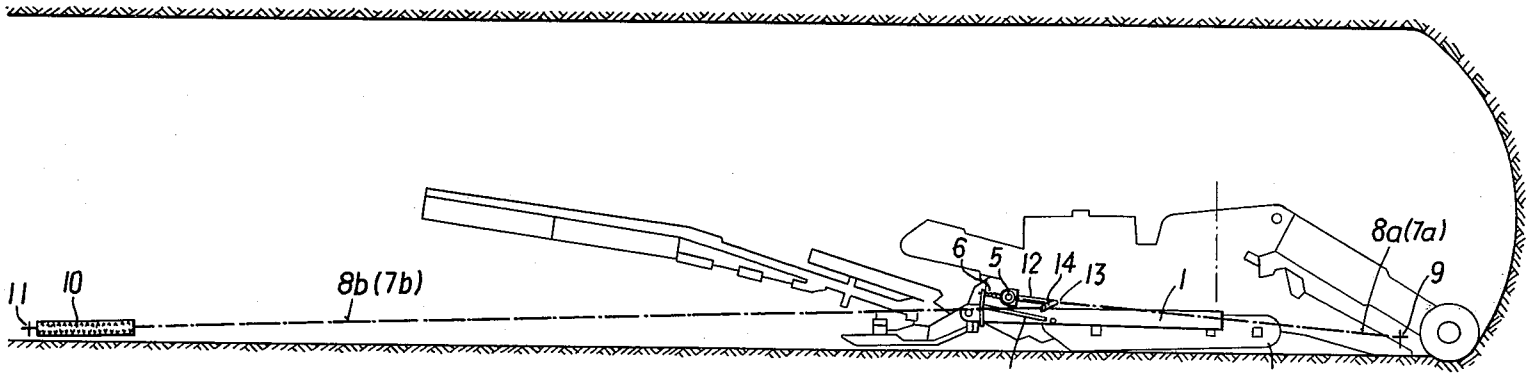

Movable cutting machines frequently must be operated on an ascending gallery. Notwithstanding of cutting machines being usually equipped with a caterpillar drive, such cutting machines are in view of the inclination of the gallery only operable to a limited extend. This limit exists because the cutting machine must have the possibility to be moved and because the cutting head must be forced against the face and the counterforce must be supplied by the chassis of the cutting machine.

It is an object of the invention to make movable cutting machines operable also in steep galleries and to particularly a cutting machine equipped with a caterpillar drive, in its operating position and for moving this machine on ascending galleries. The invention essentially consists in that at both sides of the cutting machine tension members formed of chains or ropes are provided and led over winches provided with drive means and being adapted to be fixed on both sides of the cutting machine, noting that the forward ends and the rearward ends of said tension members are adapted to be fixed at stationary locations of the gallery, preferably by means of rock anchors. In this manner, the cutting machine can be held in operating position and moved by means of its chassis and by means of the winches even on the steepest galleries. The winches provide the possibility to guy the cutting machine in both directions and to move the cutting machine in forward direction and in rearward direction.

For moving the cutting machine in rearward direction no driving force is, as a rule, required, because the cutting machine is hanging on the forward strand of the tension members which are only required to be relaxed by means of the winches. Thus, the strand extending in rearward direction is more or less only an idle strand which must only be kept under some tension. For this reason it is convenient to provide, according to the invention, on the rearward ends of the tension members spring members, by the interposition of which the tension members can be fixed to the stationary locations of the gallery.

Such winches are operating similar to vertical capstan winches. When using chains, this chain will not be wound several times around the winch because the winch can be given a profile adapted to the cain links. Such winches conveniently are winches as usually used in mines and provided with a pneumatic drive or with a hydraulic drive.

During operation of the cutting machine at the face, the winches are not operated but blocked, so that the cutting machine is guyed in its operating position. Movement of the cutting machine is mainly affected by means of its caterpillar tracks and, in dependence on the steepness of the gallery only more or less assisted by the winches. Conveniently the winches are, according to the invention, independently operable at both sides of the cutting machine. For correctly assisting the caterpillar tracks by the winches during movement of the cutting machine, the control members for the winch drive are, according to the invention, on each side of the cutting machine coupled to the control members for the caterpillar track drive of the same side.

According to the invention the arrangement is conveniently such that the winch is provided with an intake tube for guiding the tension member and that with the intake tube a guide tube is connected which serves for guiding that strand of the tension member which extends in rearward direction from the winch, said guide tube being bent in rearward direction for approximately 180° and having a mouth widening like a funnel.

Conveniently, brackets are provided at the rearward portion of the cutting machine, i.e. on its frame, which protrude on both sides and to which the winches can be suspended. By providing the position of attack of the winches at the rearward portion of the cutting machine it is considered that displacing the forward rock anchors in forward direction is limited by the face and also considered that such position of attack of the winches makes moving of the cutting machine easier to control.

A device according to the invention is operated such that, in dependence on progressing mining, new rock anchors are set on more advanced locations in front of as well as behind the mining machine and that the tension members are applied to the rock anchors set on a more advanced location.

The invention is further illustrated with reference to the drawing showing an embodiment of the invention.

In the drawing

Figure 2:
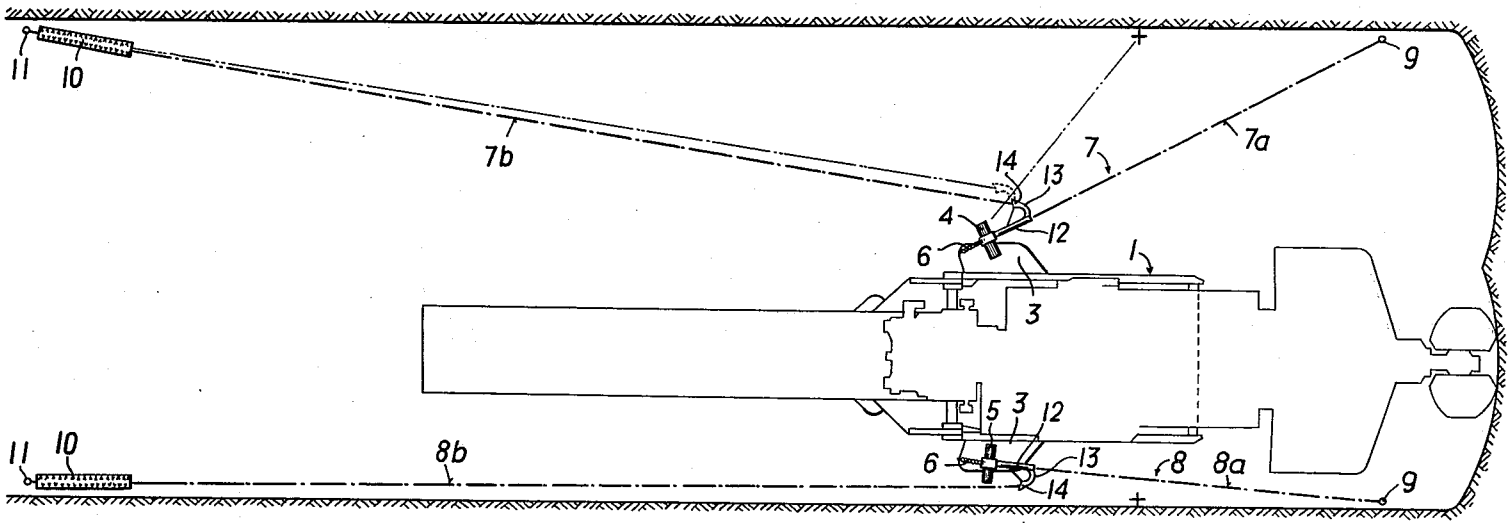
Figure 3:
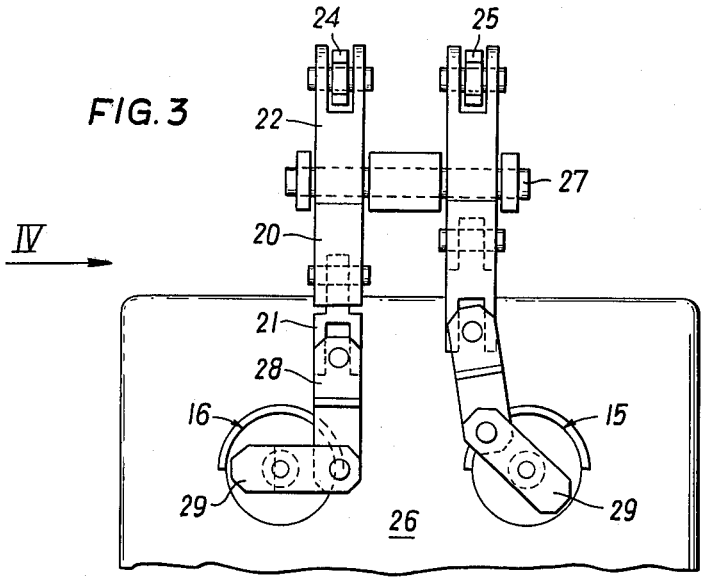
Figure 4:
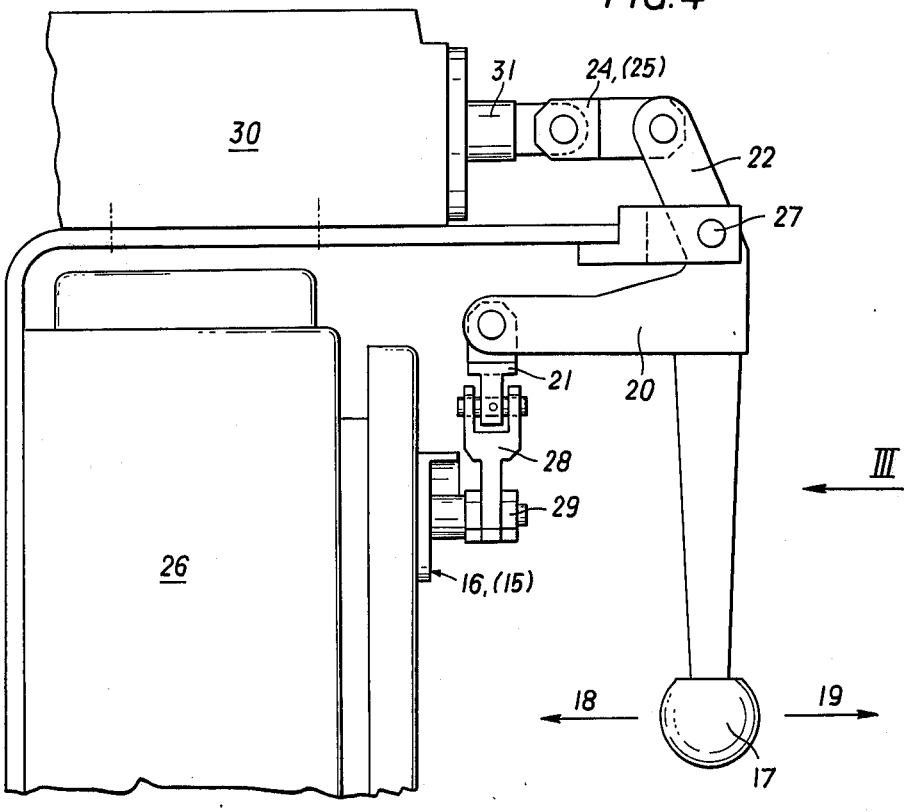

FIG. 1 represents a gallery in a side elevation with the mine floor assuming horizontal position for simplicity sake, FIG. 2 shows a top-plan view of the gallery together with the cutting machine, FIGS. 3 and 4 each show a detail, noting that FIG. 3 represents a view in direction of arrow III of FIG. 4 with control levers being removed and FIG. 4 represents a view in direction of arrow IV of FIG. 3.

The cutting machine includes a chassis 1 carried by a caterpillar drive 2. At the rearward portion of the cutting machine, brackets 3 are fixed, for example welded to the chassis. Winches 4 and 5 are hung to these brackets by means of chains 6. Chains 7 and 8 are led over these winches 4 and 5 and have their forward strands **7*a* and 8*a* fixed to rock anchors 9. The rearward strands 7*b* and 8*b* of the chains 7 and 8 are suspended to rock anchors with the interposition of spring barrels 10**.

The forward chain strands **7*a* and 8*a* are supplied to the winches 4 and 5 via guide tubes 12. Guide tubes 13 for the rearward chain strands 7*b* and 8*b* are fixedly connected to the guide tubes 12 and are bent 180°. The mouths 14 of these tubes 13** have, as seen in a top-plan view, the shape of a funnel.

The winches 4 and 5 are provided with a pneumatic drive or with a hydraulic drive. The drive units for both winches are coupled to the caterpillar track of a corresponding side of the cutting machine so that the caterpillar tracks and the winches are operated in the same sense.

An embodiment of such a coupling arrangement is shown in FIGS. 3 and 4. Two switches 15 and 16 are arranged on a gearing housing 26 for operating the caterpillar tracks. 15 is the switch for operating the right-hand caterpillar track whereas 16 is the switch for operating the left-hand caterpillar track. In dependence on the position of these switches the corresponding caterpillar track is moved in forward direction or in rearward direction. Each of these switches is operated by means of a hand lever 17 which is pivotable around a stationary axis 27 and which, for example, on movement in direction of arrow 18 effects movement in forward direction and on movement in direction of arrow 19 effects movement in rearward direction. An arm 20 of the hand lever 17 is, via links 21 and 28, connected to a switch lever 29 provided for each switch. A second arm 22 of both hand levers 17 is connected, via links 24, 25, with control rods 31 for air valves or hydraulic valves actuating the winches 4 and 5. The housing of these valves is designated 30.

Such a hand lever 17 is provided for each caterpillar track and each winch, so that, on the one hand, the switch 15 and, via the link 24, the control rod 31 for the right-hand caterpillar track and the right-hand winch and, on the other hand, the switch 16 and, via the link 25, the control rod 31 for the left-hand caterpillar track and the left-hand winch is being operated.

What we claim is:

1. In combination with a cutting machine of the kind having a frame mounted on a caterpillar drive and a cutting device projecting forwardly from the frame for cutting into a mine face: a system for guying the machine in a cutting position and for moving the machine on an ascending gallery, said system comprising a driven capstan winch carried at each side of the machine and a flexible tension member having a portion of its length intermediate its ends wrapped around each capstan winch, said tension members having forward ends anchored in rock ahead of the machine and having rearward ends anchored in rock earth behind the machine.

2. A machine as in claim 1 including a spring member connected between the rearward end of each tension member and its anchor point.

3. A machine as in claim 1 wherein the winches are independently driven.

4. A machine as in claim 3 wherein the caterpillar drive includes two independently driven tracks, each of said winches and tracks having a control member, the control member for the winch on each side of the machine being coupled to the control member for the tread on the same side.

5. A machine as in claim 1 wherein the winches are driven pneumatically.

6. A machine as in claim 1 wherein the winches are driven hydraulically.

7. A machine as in claim 1 wherein each winch is provided with an intake tube for guiding the respective tension member and with a guide tube connected to the respective intake tube for guiding that strand of the tension member which extends in rearward direction from the winch, the end of said guide tube being bent in rearward direction for approximately 180° and having a mouth widing like a funnel.

8. A machine as in claim 1 including brackets at the rearward portion of the machine frame, said brackets protruding on both sides of the machine and said winches being suspended from said brackets.

* * * * *